US008061632B2

(12) United States Patent
Petrecchia et al.

(10) Patent No.: US 8,061,632 B2
(45) Date of Patent: Nov. 22, 2011

(54) FUEL INJECTOR WITH DIRECT SHUTTER ACTUATION FOR INTERNAL COMBUSTION ENGINES

(75) Inventors: Stefano Petrecchia, Foligno (IT); Andrea Cobianchi, Bologna (IT)

(73) Assignee: Magneti Marelli S.p.A., Corbetta (IT)

( * ) Notice: Subject to any disclaimer, the term of this patent is extended or adjusted under 35 U.S.C. 154(b) by 195 days.

(21) Appl. No.: 12/385,727

(22) Filed: Apr. 17, 2009

(65) Prior Publication Data

US 2009/0261184 A1 Oct. 22, 2009

(30) Foreign Application Priority Data

Apr. 18, 2008 (EP) ..... 08425264

(51) Int. Cl.

| | |
|---|---|
| ***F02M 51/06*** | (2006.01) |
| ***F02M 51/00*** | (2006.01) |
| ***F02M 61/20*** | (2006.01) |
| ***F02M 61/10*** | (2006.01) |

(52) U.S. Cl. ..... 239/585.3; 239/533.9; 239/533.11

(58) Field of Classification Search ..... 239/533.2, 239/533.3, 533.9, 533.11, 533.12, 585.1–585.5
See application file for complete search history.

(56) References Cited

U.S. PATENT DOCUMENTS 4,651,931 A * 3/1987 Hans et al. ..... 239/533.9

FOREIGN PATENT DOCUMENTS

| | | |
|---|---|---|
| DE | 3624476 | 7/1986 |
| DE | 10348928 | 5/2005 |
| EP | 1498601 | 1/2005 |
| JP | 04143455 | 5/1992 |
| JP | 04143455 EA | 5/1992 |
| WO | WO 02/48536 | 6/2002 |
| WO | WO 03/081022 | 10/2003 |
| WO | WO 03/081022 A1 | 10/2003 |
| WO | WO 2006/063912 | 6/2006 |

OTHER PUBLICATIONS

European Search Report mailed Oct. 14, 2008 in European Appln. No. 08425264.2-1263.

* cited by examiner

*Primary Examiner* — Darren W Gorman
(74) *Attorney, Agent, or Firm* — Davidson Berquist Jackson & Gowdey, LLP

(57) ABSTRACT

A fuel injector for internal combustion engines provided with a fuel feeding channel, the feeding channel having an axis and an injection outlet; an injection valve to control the outlet; an injection valve having a shutter arranged inside the feeding channel to define, within the feeding channel, a first fuel introduction section, the shutter being movable from and to a closing position along the feeding channel, which has a second section; and an annular sealing seat arranged on the feeding channel upstream of the outlet; an elastic member for normally keeping the shutter in the closing position; an actuator mechanism connected to the shutter to displace the shutter itself from the closing position and to an opening position of the outlet; and a hydraulic resistance that is provided along the feeding channel upstream of the annular sealing seat to balance the forces acting upon the shutter.

22 Claims, 4 Drawing Sheets

FUEL INJECTOR WITH DIRECT SHUTTER ACTUATION FOR INTERNAL COMBUSTION ENGINES

TECHNICAL FIELD

The present invention relates to a fuel injector with direct actuation of the shutter for internal combustion engines.

The present invention is advantageously applied to the field of electromagnetic injectors, to which explicit reference will be made in the following description without therefore loosing in generality.

BACKGROUND ART

Usually, an electromagnetic fuel injector comprises a tubular supporting body displaying a central channel, which serves the fuel feeding function and ends with an injection nozzle adjusted by an injection valve controlled by an electromagnetic actuator. The injection valve is provided with a shutter, usually named "needle", which is firmly connected to a movable anchor of the electromagnetic actuator to be displaced between a closing position and an opening position of the injection nozzle against the bias of a spring which tends to keep the shutter in the closing position.

An example of electromagnetic fuel injector of the above-described type is provided by U.S. Pat. No. 6,027,050, which relates to a fuel injector provided with a shutter which, at one end, cooperates with an internal seat of the injection valve and, at the opposite end, is integral with a movable anchor of an electromagnetic actuator; the shutter is guided at the top by the anchor and at the bottom by a guide obtained along the internal seat of the injection valve.

The known electromagnetic injectors of the above-described type are very common because they combine good performances and low costs. However, such injectors with electromagnetic actuation of the shutter are not able to operate at relatively high fuel pressures; for this reason, injectors with hydraulic actuation of the shutter have been proposed, i.e. injectors in which the displacement of the shutter from a closing position to an opening position against the bias of the previously mentioned spring no longer occurs against the direct bias of the electromagnetic actuator, but occurs under the bias of hydraulically originated forces controlled by the electromagnetic actuator, which no longer serves the function of power member, but functions as a control member. An example of injector with hydraulic actuation of the shutter is provided by EP-A-1036932, by EP-A-0921302 and by WO-A-0129395.

Specifically, in an injector with hydraulic actuation of the shutter, the fuel which enters the injector comes from a high-pressure pump; a considerable amount of this fuel, which is aspirated from a tank, is not however involved in the combustion process inside the cylinder, and is returned to the tank itself. Indeed, of all the fuel fed to the injector, a first fraction reaches the injection valve through the central feeding channel, while a second fraction fills a control chamber arranged upstream of the shutter and serving as a chamber of a hydraulic cylinder, a piston of which is directly connected to the shutter. The hydraulic cylinder displays an exhaust connected to the tank by means of a fuel return pipe and controlled by a sealing member controlled by the electromagnetic actuator. When the magnet of the electromagnetic actuator is energized, the sealing member is displaced by connecting the chamber of the hydraulic cylinder to the return pipe so as to determine a pressure drop inside the hydraulic cylinder and to allow the shutter to be displaced to the open position.

An injector with hydraulic actuation of the shutter displays good dynamic performances and is able to operate at relatively high fuel pressures, but is complex and relatively expensive because it requires to make an internal hydraulic circuit controlled by an electromagnetic or, alternatively, a piezoelectric actuator. Furthermore, using an injector with hydraulic actuation of the shutter always provides a return flow of fuel at ambient pressure to the tank. This return flow represents a loss of energy and tends to heat the fuel within the tank. Finally, the high-pressure pump must also be over-dimensioned with respect to the actual fuel consumption by the engine, because part of the pumped fuel is not injected into the cylinders, but is re-introduced at ambient pressure into the tank; i.e. the high-pressure pump must supply both the fuel used by the engine and the fuel required for the operation of the injectors with hydraulic actuation of the shutter.

DISCLOSURE OF INVENTION

It is the object of the present invention to make a fuel injector with hydraulic actuation of the shutter, which is essentially free from the above-described drawbacks.

According to the present invention, a fuel injector is provided as claimed in the attached claims.

BRIEF DESCRIPTION OF THE DRAWINGS

The present invention will now be described with reference to the accompanying drawings, which show non-limitative embodiments thereof, in which.

BEST MODE FOR CARRYING OUT THE INVENTION

Figure 1:
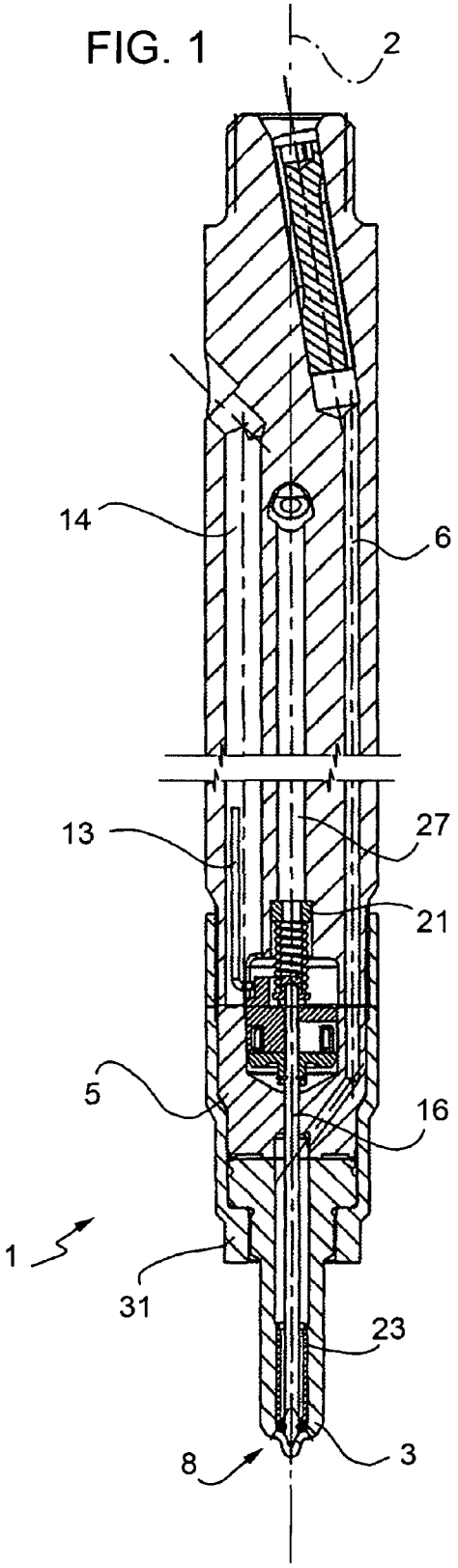
FIGS. 1 and 2 show respective diagrammatic side sections, with parts removed for clarity, of a first preferred embodiment of the fuel injector of the present invention.

In FIG. 1, numeral 1 indicates as a whole a fuel injector, which essentially displays a cylindrical symmetry about a longitudinal axis 2 thereof, comprises, at one end thereof, an injection nozzle 3 displaying outlet holes 4 and is controlled to inject fuel directly into a combustion chamber (not shown) of a cylinder (not shown) by means of the injection nozzle 3; the fuel is injected through the outlet holes 4 and vaporizes when the air, due to the compression inside the combustion chamber (not shown), reaches a temperature such as to trigger the combustion process.

The injector 1 comprises a supporting body 5, which has a tubular shape with variable section along the longitudinal axis 2, displays a feeding channel 6, which extends along the supporting body 5 for feeding the pressurized fuel from a high-pressure pump (not shown) to the injection nozzle 3, and displays a lower portion 2 which is coaxial to the longitudinal axis 2.

The supporting body 5 accommodates an electromagnetic actuator 7 for actuating an injection valve 8 for adjusting the fuel flow through the injection nozzle 3.

The electromagnetic actuator 7 comprises a magnet 9, which is accommodated in a fixed position within the supporting body 5 and, when energized, displaces a movable anchor 10 made of ferromagnetic material along the axis 2 from a closing position to an opening position of the injection valve 8 against the bias of a spring 11, which tends to keep the movable anchor 10 in the closing position of the injection valve 8. The magnet 9 further comprises a coil 12, which is electrically supplied by an electronic control unit (not shown), outside the injector 1, by means of an electric wire 13 accommodated within a pipe 14 obtained along the supporting body 5, which further accommodates a fixed magnetic yoke 15 therein.

The movable anchor 10 is part of a moving part which further comprises a shutter 16, having an upper portion 17 integral with the movable anchor 10 and a lower portion 18 cooperating with an internal sealing seat 19 of the injection valve 8 in order to adjust the fuel flow through the injection nozzle 3.

The upper portion 17 of the shutter 16 carries connected a connection element 20, which cooperates with an end of the spring 11, which is compression-fitted between the connection element 20 and a calibrated bushing 21 of the supporting body 5 to normally keep the anchor 10 and then the shutter 16 in the closing position of the injection valve 8.

The lower portion 18 of the shutter 16 is accommodated within the feeding channel 6 and ends with a shutting head 22, which displays an essentially triangular shape in section and which is adapted to engage the internal sealing seat 19 of the injection valve 8, which also displays an essentially triangular shape in section which copies the triangle shape of the shutting head 22.

The shutting head 22 is biased by the spring 11 against the internal sealing seat 19 of the injection valve 8 to the closing position of the injection valve 18 itself. Accordingly, in order to pass from this position to the opening position, the shutting head 22 is displaced along the longitudinal axis 2 upwards; in other words, in order to open the injection valve 8, the shutter 16 is displaced in a direction which is opposite to the feeding direction of the fuel. The shutting head 22 displays a diameter $D_1$ which is equal to a sealing diameter $D_2$ of the internal sealing seat 19 of the injection valve 8 so that, in the closing position, the shutter head 22 completely covers the outlet holes 4 of the injection nozzle 3 by preventing the release of fuel.

Figure 3:
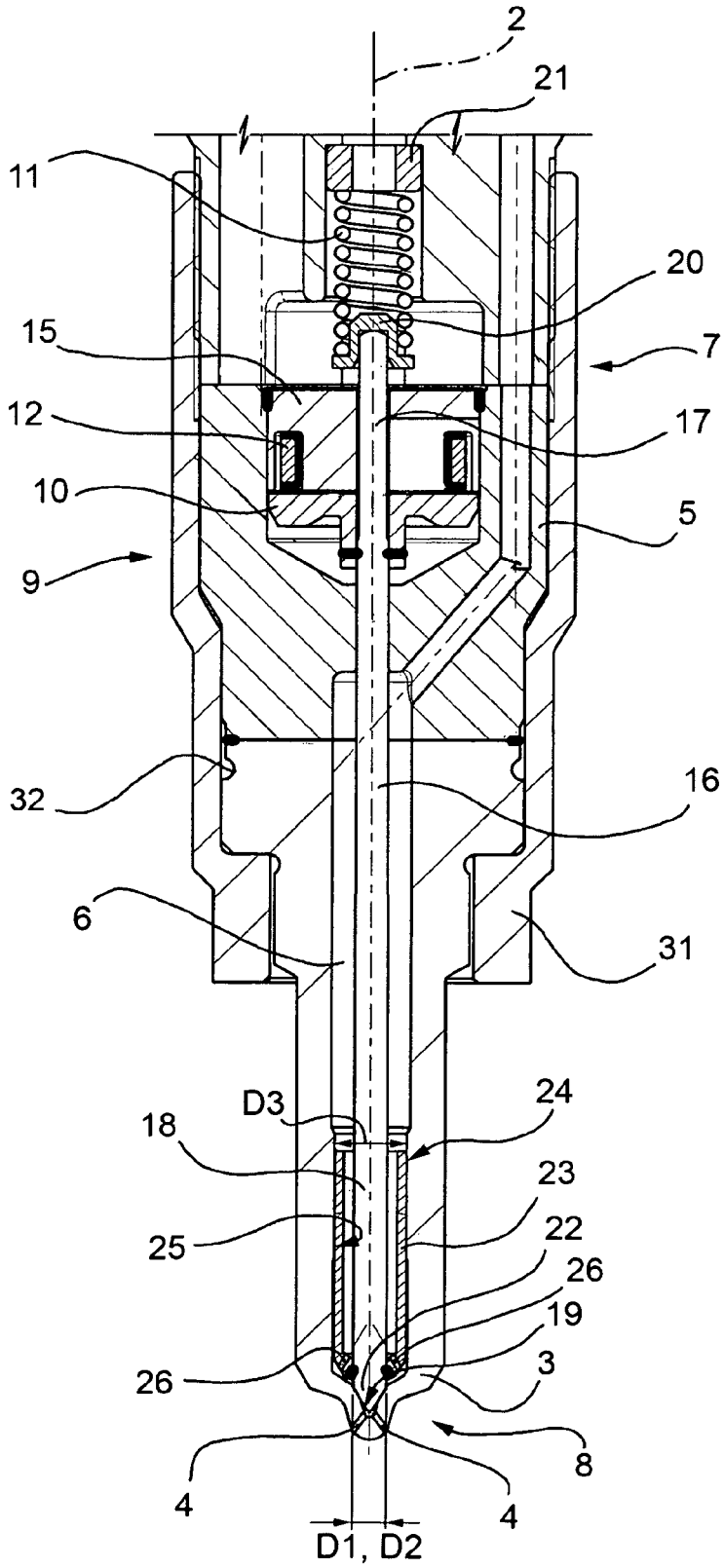
FIG. 3 shows a detail of the injector in FIG. 1 on an enlarged scale.

As shown in FIG. 3, the shutting head 22 is integrally connected to a compensation bushing 23, which is displaced along the feeding channel 6 with the shutter 16, is coaxial to the longitudinal axis 2 and is arranged with an external wall 24 in contact with an internal surface 25 of the feeding channel 6. The compensation bushing 23 displays at least one compensating hole 26, in this case two or more compensating holes 26, each of which leads to the internal sealing seat 19 to allow the flow of pressurized fuel to the internal sealing seat 19 itself. The fuel flowing through the feeding channel 6, is then conveyed into the pipe delimited by the shutter 16 and by the compensation bushing 23.

In the opening position of the injection valve 8, the shutting head 22 is separate from the internal sealing seat 19 creating a passage for the fuel flowing out from the compensating holes 26 of the compensation bushing 23 and, then, from the outlet holes 4 of the injection nozzle 3 to be atomized into the combustion chamber (not shown) of the cylinder (not shown).

Figure 2:
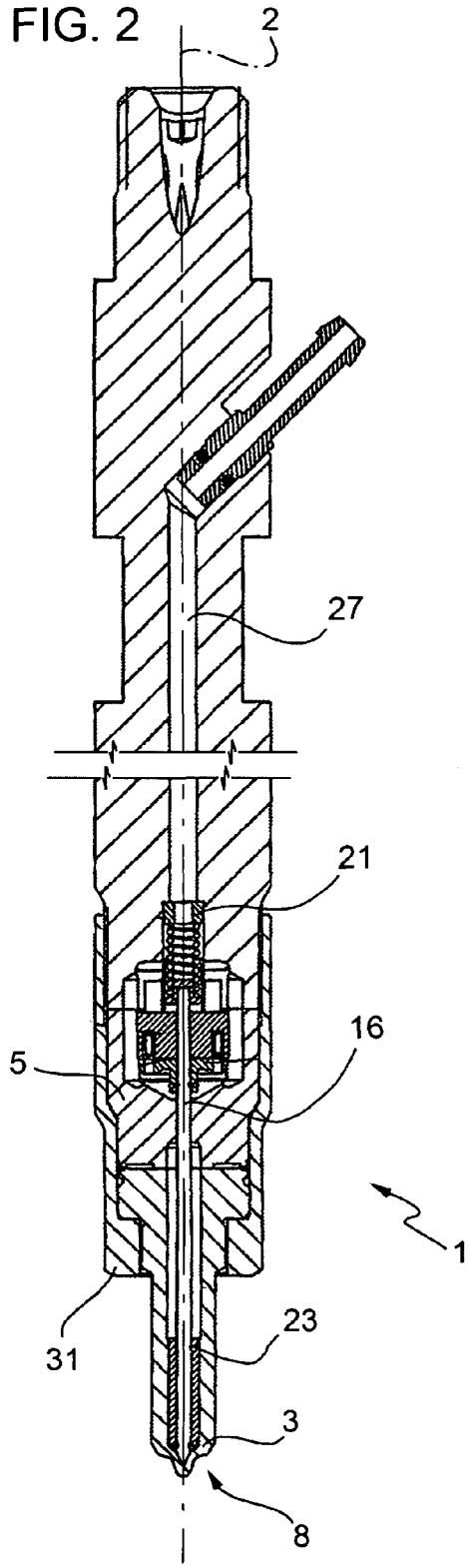

As shown in FIGS. 1 and 2, the injector 1 comprises a seeping pipe 27, which is coaxial to the longitudinal axis 2, originates from the calibrated bushing 21 and is adapted to receive a small amount of fuel at ambient pressure, which is conveyed to the calibrated bushing 21 by seeping because the different components of the injector 1 are not hydraulically insulated from each other.

It is worth emphasizing that the distance between the shutting head 22 and the movable anchor 10 is shorter than the distance existing between the internal sealing seat 19 and the fixed magnetic yoke 15, and that the stroke of the shutter 16 is equal to the difference between these two distances. Furthermore, in order not to cancel the gap existing between the movable anchor 10 and the fixed magnetic yoke 15 when the shutter 16 is arranged in the opening position and the movable anchor 10 abuts against the fixed magnetic yoke 15, a disc made of non-magnetic material is interposed between the last two components, which disc is adapted to prevent the movable anchor 10 from magnetically sticking onto the fixed magnetic yoke 15.

In use, when the magnet 9 is de-energized, the movable anchor 10 is not attracted by the fixed magnetic yoke 15 and the spring 11 biases the movable anchor 10 and therefore the shutting head 22 of the shutter 16 against the internal sealing seat 19 of the injection valve 8, thus preventing the release of fuel. When the magnet 9 is energized, the movable anchor 10 is magnetically attracted by the fixed magnetic yoke 15 and, overcoming the elastic force of the spring 11, is displaced, along with the shutter 16, so as to detach the shutting head 22 of the shutter 16 from the internal sealing seat 19 of the injection valve 8 in order to allow the pressurized fuel to flow through the injection valve 8.

These injection systems work at very high injection pressures, in the order of 1800 bars, and the components of the injector 1, specifically the shutter 16, must be made so as to correctly operate under the action of extremely high forces.

When the injection valve 8 is in the closing position, no hydraulic forces act on the shutter 16, because the diameter $D_1$ of the shutting head 22 is equal to the sealing diameter $D_2$ of the internal sealing seat 19 of the injection valve 8 and because inside the seeping pipe 27 the fuel is at ambient pressure. The shutter 16 in the closing position is thus perfectly balanced.

On the contrary, when the injection valve 8 is opened, there is a pressure drop in the fuel fluid due to the passage through the compensating holes 26 of the compensation bushing 23. In this position, the shutter 16 is subjected to two antagonist hydraulic thrusts F1 and F2, a first F1 due to the pressurized fuel inside the feeding channel 6 and a second F2 due to the fuel at lower pressure which is downstream of the compensating holes 26.

The first hydraulic thrust is equal to a pressure P1, typically 1800 bars, of the fuel inside the annular section pipe existing between the shutter 16 and the internal surface 25, of diameter $D_3$, of the feeding channel 6 multiplied by an area A1 of the aforementioned annular section. On the other hand, the second hydraulic thrust is equal to a pressure P2<P1, where ΔP=(P1−P2) is due to the pressure drop through the compensating holes 26, multiplied by an area A2, obviously with A2>A1, of the feeding channel 6.

The equality of the two hydraulic thrusts is obtained by satisfying the equation:

$$F1=A1\times P1=F2=A2\times P2$$

by acting on the width of the ports of the compensating holes 26 which determines the value ΔP.

If the equation stated above is satisfied, the shutter 16 is essentially balanced even in the opening position. Accordingly, it is possible to avoid using a hydraulic actuator for displacing the shutter 16 to the opening position, and it is sufficient to use the electromagnetic actuator 7, the task of which is essentially to overcome the resistance of the spring 11.

Figure 4:
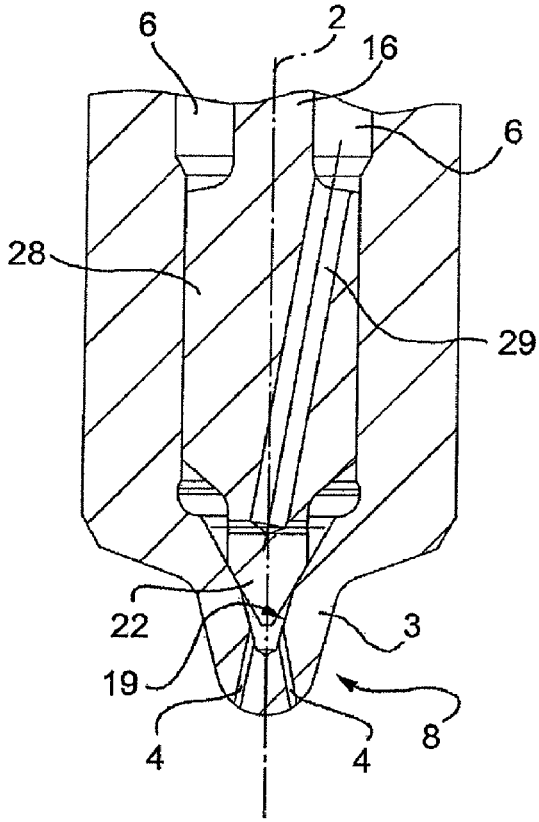
FIG. 4 is a section view of a variant of a first detail in FIG. 3 on an enlarged scale.

According to the variant shown in FIG. 4, the compensation bushing 23 is eliminated and the shutter 16 is provided, at the free end thereof, with an oversized portion 28, the external diameter of which rounds down the internal diameter of the injection nozzle 3, i.e. the diameter $D_3$ of the feeding channel 6. At least one small-section compensating channel 29 is made through the oversized portion 28, which channel reciprocally connects the portions of the feeding channel 6 arranged upstream and downstream, respectively, of the oversized portion 28, leads to the shutting head 22 and serves the same function as the compensating holes 26.

Figure 5:
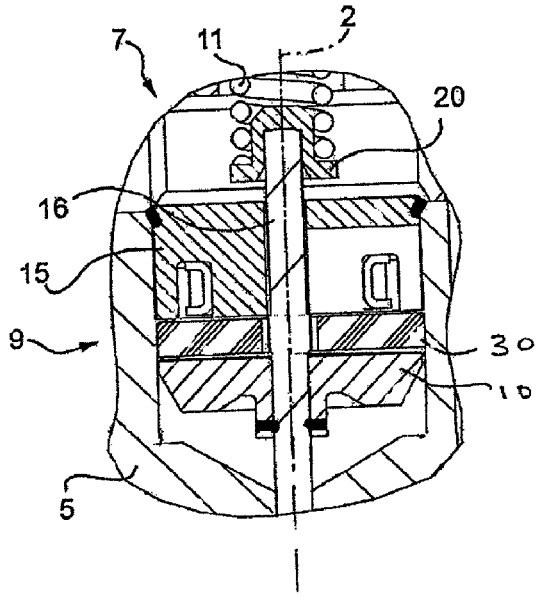
FIG. 5 shows a variant of a second detail in FIG. 3 on an enlarged scale.
Figure 6:
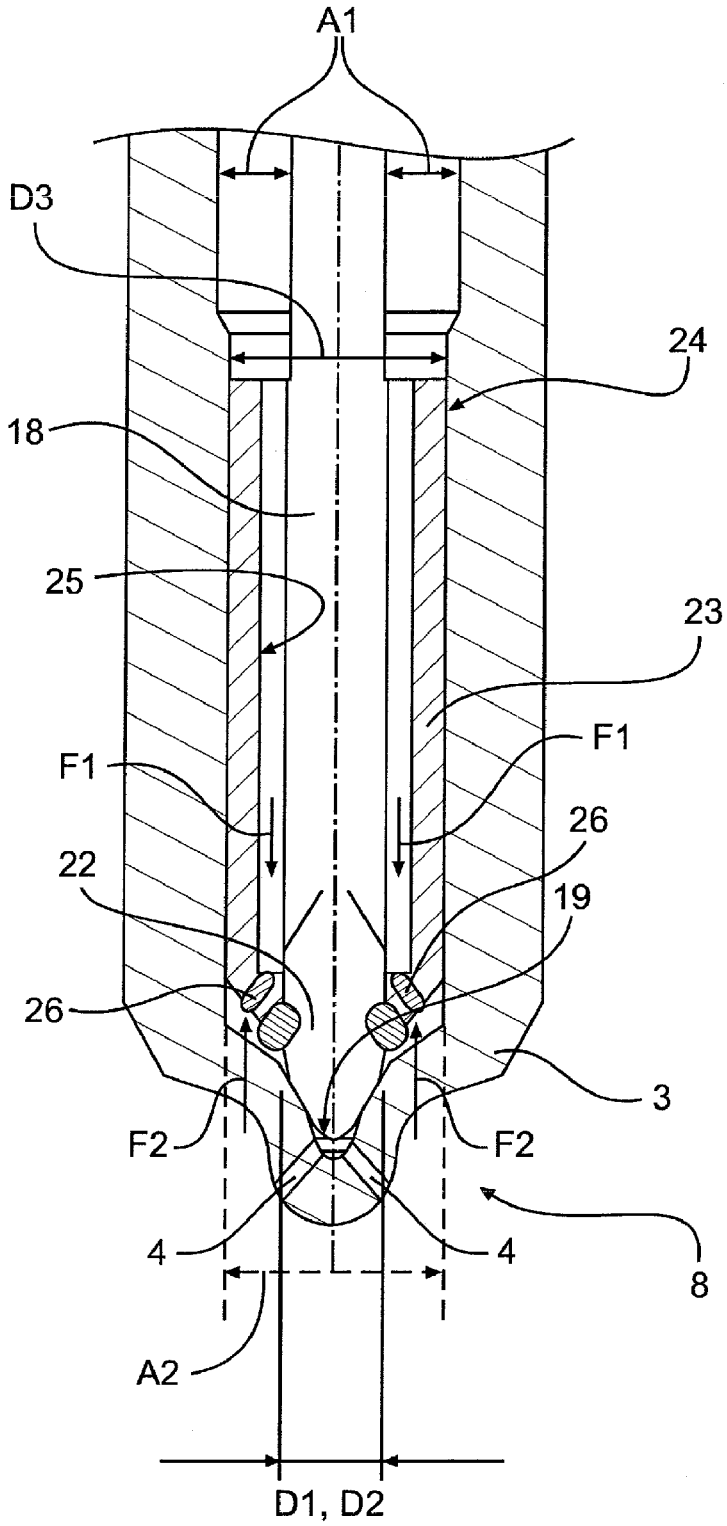
FIG. 6 is an enlarged view of the bottom portion of FIG. 3 showing the location of the areas A1 and A2, and the hydraulic thrusts Fl and F2 being created when the injection valve is opened.

According to the variant shown in FIG. 5, an annular, non-magnetic, separating disc 30, preferably made of TEFLON, is coaxially arranged with respect to the longitudinal axis 2 facing the movable anchor 10. The annular separating disc 30 serves the function of heat shield adapted to keep reciprocally separate the thermal flow generated, by induction, by the electromagnetic actuator 7 and the thermal flow caused by the temperature increase sustained by the fuel because of the seeping towards the calibrated bushing 21, and to avoid cancelling the gap existing between the anchor 10 and the fixed magnetic yoke 15.

During the step of assembling the injector 1, all the components are pre-assembled in different groups before the final assembly achieved by means of a retaining nut 31. The structure of the injector 1 implies very low tolerances for the various components; for this purpose, the body of the injector displays some external grooves 32 which follow these construction needs and increase the resistance of the injector 1 in order to guarantee the welding sealing, to facilitate the assembly of the injector 1 and to favour the local deformability of certain components subjected to temperature increase.

According to a variant (not shown), the magnet 9 displays a slot, which is made on a plane coaxial to the longitudinal axis 2 and is adapted to reduce the intensity of the generated eddy currents.

According to a further variant (not shown), the diameter $D_1$ of the shutting head 22 rounds the sealing diameter $D_2$ of the internal sealing seat 19 of the injection valve 8. In the closing position of the injection valve 8, a relatively low force is thus generated, acting on the shutter 16, which tends to either close or open the injection valve 8, if this force is, respectively, either added to or subtracted from the force exerted by the spring 11.

It is worth emphasizing that the above-described injector 1 displays many advantages. The fraction of fuel which is not involved in the combustion process and returns to the tank is quite small, nearly null, allowing to reduce the dimensions and the power of the high-pressure pump arranged upstream of the injector 1. Furthermore, the direct actuation of the shutter 16 by the electromagnetic actuator 7 allows to eliminate any hydraulic power device to control the position of the shutter 16, thus reducing the assembly times and costs and therefore simplifying the construction of the injector 1.

The invention claimed is:

1. A fuel injector for internal combustion engines comprising:

a fuel feeding channel having an axis and an injection outlet;

an injection valve controlling flow through the injection outlet; the injection valve including a shutter arranged inside the fuel feeding channel to define, within the fuel feeding channel, a first fuel introduction section (A1), the shutter being movable from and to a closing position along the feeding channel, and a second section (A2); and a sealing seat arranged adjacent an end of the fuel feeding channel upstream of the outlet;

an elastic member that biases the shutter in a closing position; and an actuator mechanism connected to the shutter to displace the shutter away from the closing position and to an opening position of the outlet;

wherein a hydraulic resistance is arranged along the fuel feeding channel upstream of the sealing seat to balance forces acting upon the shutter; and wherein the hydraulic resistance is constructed so as to determine, along the fuel feeding channel and upstream of the sealing seat, a pressure drop so that the shutter is subjected, when spaced from the closing position, to two antagonist hydraulic forces F1 and F2 such as to satisfy the equation:

$$F1=A1\times P1=F2=A2\times P2 \text{ , wherein:}$$

A1=area of the first section;

P1=fuel feeding pressure;

A2=area of the second section; and

P2=fuel pressure inside the feeding channel and downstream of the hydraulic resistance means.

2. The injector according to claim 1, wherein the hydraulic resistance is movable with the shutter along the feeding channel.

3. The injector according to claim 1, wherein said hydraulic resistance comprises a compensation bushing, which is connected to the shutter, is coaxial to said axis and is slidingly coupled to an internal surface of the fuel feeding channel; and at least one compensating hole formed within the compensation bushing as a fuel port directed towards the outlet.

4. The injector according to claim 3, wherein the compensation bushing is connected to the shutter at one end thereof facing towards the outlet; the at least compensating hole being positioned at a lower end of the compensation bushing.

5. The injector according to claim 4, further comprising a plurality of compensating holes, which are uniformly distributed about said axis.

6. The injector according to claim 1, wherein said hydraulic resistance comprises an oversized portion of the shutter arranged at an end of the shutter facing the outlet; and at least one compensating channel formed within the oversized portion, and having an external diameter which approximates by defect a diameter ($D_3$) of the feeding channel; the at least one compensating channel reciprocally connecting portions of the feeding channel arranged, respectively, upstream and downstream of the oversized portion.

7. The injector according to claim 1, wherein the shutter terminates with a shutting head adjacent the outlet that engages and closes the outlet when the shutter is in the closing position.

8. The injector according to claim 7, wherein the shutting head has a diameter ($D_1$) equal to a diameter ($D_2$) of the sealing seat (19).

9. The injector according to claim 7, wherein the shutting head has a diameter ($D_1$) which approximates a diameter ($D_2$) of the sealing seat.

10. The injector according to claim 8, wherein the shutting head has, in axial section, an essentially triangular shape and engages, when the shutter is in the closing position, an end segment of the fuel feeding channel adjacent said outlet; said end segment also having, in axial section, an essentially triangular shape which is complementary to the triangular shape of the shutting head.

11. The injector according to claim 1, wherein the actuator mechanism comprises an electrically operated actuator.

12. The injector according to claim 1, wherein the actuator mechanism comprises an electromagnetic actuator.

13. The injector according to claim 12, wherein the electromagnetic actuator comprises at least one coil, at least one fixed magnetic yoke, and at least one annular movable anchor, which is magnetically attracted by the at least one fixed magnetic yoke against the bias of the elastic member and is integrally connected to the shutter, the shutter having a stroke, the length of which is determined by the difference between the distance between a shutting head and at least one movable anchor positioned on the shutter at a point spaced from the shutting head on one side and the distance existing between the sealing seat and the at least one fixed magnetic yoke on the other side.

14. The injector according to claim 13, further comprising a disc made of non-magnetic material interposed between the movable anchor and the fixed magnetic yoke to avoid cancelling the gap existing between the movable anchor and the fixed magnetic yoke.

15. The injector according to claim 13, wherein the coil is embedded in the fixed magnetic yoke.

16. The injector according to claim 1, wherein the elastic member comprises a spring for keeping the shutter in the closing position; the spring being compression-fitted between a calibrated bushing of a supporting body and a connection element, which in turn is connected to an upper portion of the shutter.

17. The injector according to claim 16, further including a seeping pipe, which is coaxial with the axis and originates from the calibrated bushing to receive a small amount of fuel at ambient pressure.

18. The injector according to claim 13, further including an annular separating disc, which is arranged in a position coaxial with the axis and facing the at least one movable anchor.

19. The injector according to claim 18, wherein the annular separating disc is made of polytetrafluroethylene.

20. The injector according to claim 1, wherein the final assembly of the components is performed by means of a retaining nut.

21. The injector according to claim 1, further including a supporting body and an injection nozzle having external grooves formed thereon.

22. A fuel injector for internal combustion engines comprising:

a fuel feeding channel having an axis and an injection outlet;

an injection valve controlling flow through the injection outlet; the injection valve including a shutter arranged inside the fuel feeding channel to define, within the fuel feeding channel, a first fuel introduction section (A1), the shutter being movable from and to a closing position along the feeding channel, and a second section (A2); and a sealing seat arranged adjacent an end of the fuel feeding channel upstream of the outlet;

an elastic member that biases the shutter in a closing position;

an actuator mechanism connected to the shutter to displace the shutter away from the closing position and to an opening position of the outlet;

a hydraulic resistance arranged along the fuel feeding channel upstream of the sealing seat to balance forces acting upon the shutter, said hydraulic resistance comprising a compensation bushing connected to the shutter so as to be coaxial to said axis and slidingly coupled to an internal surface of the fuel feeding channel; and at least one compensating hole formed within the compensation bushing as a fuel port directed towards the outlet.

* * * * *